US005100749A

United States Patent [19]

Narikawa et al.

[11] Patent Number: 5,100,749

[45] Date of Patent: * Mar. 31, 1992

[54] PHOTOSENSITIVE MEMBER FOR ELECTROPHOTOGRAPHY

[75] Inventors: Shiro Narikawa, Kashihara; Takashi Hayakawa; Kunio Ohashi, both of Nara, all of Japan

[73] Assignee: Sharp Kabushiki Kaisha, Japan

[ * ] Notice: The portion of the term of this patent subsequent to Nov. 20, 2007 has been disclaimed.

[21] Appl. No.: 656,430

[22] Filed: Feb. 19, 1991

[30] Foreign Application Priority Data

Feb. 20, 1990 [JP] Japan ..... 2-40718

[51] Int. Cl.[5] ..... G03G 5/028

[52] U.S. Cl. ..... 430/65; 430/84; 430/130

[58] Field of Search ..... 430/65, 84, 130

[56] References Cited

U.S. PATENT DOCUMENTS 4,698,288 10/1987 Mort ..... 430/58
4,900,646 2/1990 Senske et al. ..... 430/64
4,971,878 11/1990 Hayakawa et al. ..... 430/84

*Primary Examiner*—Marion E. McCamish
*Assistant Examiner*—S. Rosasco
*Attorney, Agent, or Firm*—Nixon & Vanderhye

[57] ABSTRACT

An improved photosensitive member for electrophotography which comprises an intermediate layer, a photoconductive layer and a surface protecting layer each formed upwardly in this order on a conductive substrate, the photoconductive layer comprising a non-doped a-Si layer made of a amorphous silicon containing hydrogen and/or halogen of 40 at. % or more.

4 Claims, 2 Drawing Sheets

PHOTOSENSITIVE MEMBER FOR ELECTROPHOTOGRAPHY

BACKGROUND OF THE INVENTION

1. Field of the Invention

This invention relates to a photosensitive member for electrophotography, and more particularly to a photosensitive member for electrophotography of negative charge type which is useful as a photoreceptor of duplicator.

2. Description of the Related Art

In recent years, a photosensitive member for electrophotography made of an a-Si (amorphous silicon) having excellent properties of high photoconductivity and high hardness and being non-pollutive has been given special notices. The a-Si photosensitive member is generally fabricated; by plasma CVD process in such manner that a source gas such as monosilane (SiH4) or disilane ($Si_2H_6$) is introduced into a vacuum chamber and applied with a radio frequency (rf) power to form a glow discharge, so that the source gas is decomposed to deposit a photoconductive layer mainly of a-Si on a substrate; or by reactive sputtering process in such manner that a silicon wafer is used in place of the above source gas as a target for sputtering and $H_2$, He, Ar or like gas is introduced and applied with a rf power to form a glow discharge so as to sputter the target Si wafer, thereby depositing a photoconductive layer mainly of a-Si on the substrate.

The a-Si photoconductive layer fabricated above usually contains hydrogen of 10 to 30 at. % and exhibits a slightly n-type conduction even when not added, i.e., non-doped, with a conductivity-controlling impurity (for example, B (boron) of III group element, P (phosphorus) of V group element and the like). Since the electron as a carrier is superior in mobility than the hole, the a-Si photoconductive layer inherently exhibits a high photoconductivity but shows a relatively high dark conductivity such as $10^{-9}$ to $10^{-10}$ S/cm. The photoconductive layer having such conductivities, when applied as it is to a photosensitive member for electrophotography of negative charge type, is inferior in charge acceptance and dark decay characteristic (charge retentivity) due to the relatively high dark conductivity.

In this regard, there have been proposals in the production of a photosensitive member for electrophotography of negative charge type:

(1) Adding a chemical modifier such as C, N, O or the like in the a-Si photoconductive layer of the member to lower the dark conductivity, or (2) Constituting the photoconductive layer of the member with a carrier-generation layer made of a non-doped a-Si and a carrier-transportation layer made of an a-Si added with the chemical modifier C, N, O or the like.

These proposals, however, have a drawback that although the dark conductivity of the photoconductive layer constituting the photosensitive member is lowered, the photoconductivity thereof is also lowered as the dark conductivity lowers. Further, according to these proposals, a n-type high photoconductivity which is the characteristic of the non-doped a-Si is not utilized nor developed while necessitating the addition of the chemical modifier and the cumbersome control of addition amount thereof.

In the meantime, it has been known that an a-Si layer can be fabricated by ECR process (electron cyclotron resonance process) (U.S. Pat. No. 4,532,199). Also, we have proposed that an a-SiGe layer, an a-Si/a-SiGe composite layer or an a-SiX layer (wherein X represents C, N or O) each fabricated by ECR process can suitably be applied as a photoconductive layer of photosensitive member for electrophotography mainly of positive charge type (US patent application Ser. Nos. 368,807, 372,019 and 369,473). However, it is still not known of fabricating by ECR process an a-Si photoconductive layer in the photosensitive member for electrophotography of negative charge type.

SUMMARY OF THE INVENTION

According to the present invention, there is provided a photosensitive member for electrophotography comprising an intermediate layer, a photoconductive layer and a surface protecting layer each deposited upwardly in this order on a conductive substrate, wherein the photoconductive layer comprises a non-doped a-Si layer made of an amorphous silicon containing hydrogen and/or halogen of 40 at. % or more.

The invention is based on the inventor's discovery of such a fact that using the non-doped a-Si layer as defined above as a photoconductive layer of the photosensitive member of negative charge type enables the photosensitive member to exhibit an excellent charge acceptance and dark decay characteristic.

In the photosensitive member of the present invention, the photoconductive layer can simply be fabricated without doping impurity such as B or P or adding chemical modifier such as C, N or O. Therefore, in addition to the merit of enabling the characteristic of a non-doped a-Si to be developed for the photoconductive layer, the photosensitive member can take such an advantage in production of being efficiently fabricated with higher photoconductivity and lower dark conductivity.

DETAILED DESCRIPTION OF THE PREFERRED EMBODIMENTS

Figure 1:
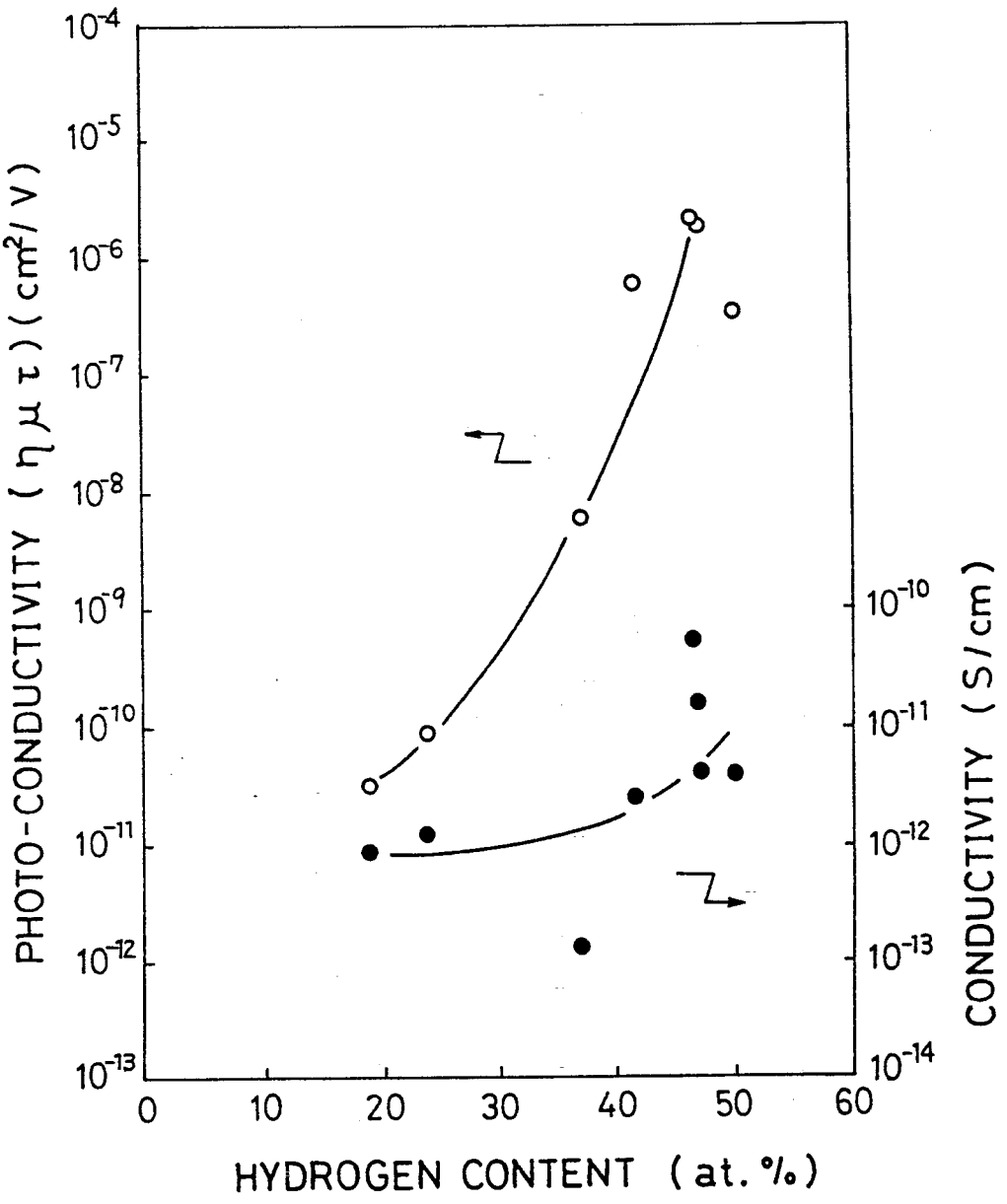
FIG. 1 is a diagram showing a property of an a-Si layer of the present invention prepared by ECR process.

The conductive substrate may employ conventional materials available in the art, for example, metals such as Al, Cr, Mo, Au, Ir, Nb, Ta, Pt, Pd and the like, or a plate made from alloys provided from those metals. Also, available are a film or a sheet made of synthetic resins such as polyester, polyethylene, cellulose acetate, polypropylene and the like, or a sheet made of glass, ceramic and the like, the surfaces of the film or sheet being coated with a conductive layer. The substrate may be formed in any shape suitable for the purpose (for example, a drum and the like) and is not limited to a particular shape.

In the photosensitive member for electrophotography of the present invention, the intermediate layer which prevents the injection of holes from the conductive substrate to the photoconductive layer is first fabricated on the above conductive substrate. The intermediate layer may be a conventional a-Si layer doped with a n-type impurity (for example, phosphorus) optionally containing a chemical modifier. Most preferable is a doped a-Si layer (n-type impurity of $10^{16}$ to $10^{21}/cm^3$) having a thickness of 0.2 to 20 μm fabricated, for example, in accordance with a conventional PCVD process or sputtering process, or ECR process.

The photoconductive layer is deposited on the intermediate layer, comprising an a-Si layer which contains hydrogen and/or halogen of 40 at. % or more and not doped with any impurity such as B or P, or a chemical modifier and the like.

The non-doped a-Si layer defined above can be prepared in accordance with ECR process using as a source gas, for example, $SiH_4$, $Si_2H_6$, $SiF_4$, $SiCl_4$, $SiHCl_3$, $SiH_2Cl_2$ and the like, solely or in combination. It is preferable that an applied microwave power in ECR process be 0.5 to 5 kW, source gas flow be 50 to 500 sccm, and the gas pressure under deposition be $10^{-5}$ to $10^{-2}$ Torr. Also, it is preferable that the thickness of the non-doped a-Si layer be 10 to 50 μm and the hydrogen and/or halogen content be 40 to 60 at. %, most preferably be 42 to 55 at. %.

The surface protecting layer is fabricated on the photoconductive layer to complete the photosensitive member of the present invention. The surface protecting layer may be preferably provided for protecting the photosensitive member from physical or chemical damage such as corona discharge, and may preferably be an a-Si layer added with a chemical modifier such as C, N, O and the like, i.e., a-SiC, a-SiN or a-SiO layer and the like. The surface protecting layer can be fabricated in accordance with a conventional PCVD process or ECR process using a silicon source gas similarly with the aforesaid process and a chemical modifier source gas such as hydrocarbons (for example, $CH_4$, $C_2H_6$, $C_3H_8$, and the like), $NH_3$, $O_2$, $CO_2$ and the like. It is preferable that the concentration of the chemical modifier element be 10 to 200 at. % and the thickness of the surface protecting layer be 0.1 to 10 μm.

The hydrogen and/or halogen content in an a-Si layer fabricated in accordance with a conventional plasma CVD process or reactive sputtering process, is generally 10 to 30 at. %, but that in an a-Si layer fabricated in accordance with ECR process is possibly around 40 at. % to 60 at. %.

ECR process employs the formation of plasma based on the resonance between electron and microwave in magnetic field to make deposition in the presence of the Si source gas and has the following features. gas is notably promoted in dissociation, (1 ) The source gas is notably promoted in dissociation, excitation and ionization to provide a higher deposition rate due to the existence of high energy of electrons in comparison with the conventional deposition processes, and the gas usage efficiency can also be increased.

(2) Plasma can be excited stably under a relatively low pressure ($10^{-5}$ to $10^{-3}$ Torr), and the formation of polymeric powder of $(SiH_2)n$ based on the secondary reaction of radicals during deposition can be prevented.

(3) Ionic species produced from the source gas give a suitable energy to the substrate or like thereby forming a high quality film without heating the substrate or like.

The a-Si layer obtained by ECR process has the following characteristics.

(1) Being high hydrogen and/or halogen content as aforesaid, (2) Having an optical bandgap of about 1.8 to 2.2 eV, (3) Having a lower dark conductivity of $10^{-12}$ to $10^{-11}$ S/cm in comparison with an a-Si film fabricated by the conventional deposition process; and having a higher photoconductivity of $10^{-7}$ to $10^{-6}$ $cm^2/V$ in the case of hydrogen and/or halogen content being 40 at. % or more; thereby providing a higher contrast in electrophotography.

Accordingly, when the a-Si layer being not doped with impurity but having hydrogen and/or halogen content of 40 at. % or more is used as a photoconductive layer, the photosensitive member for electrophotography having an excellent charge acceptance and dark decay characteristic can be fabricated without decreasing the inherent excellent photoconductivity of a-Si.

EXAMPLES

Next, the invention will be detailed with referring to the examples shown in the accompanied figures.

Figure 3:
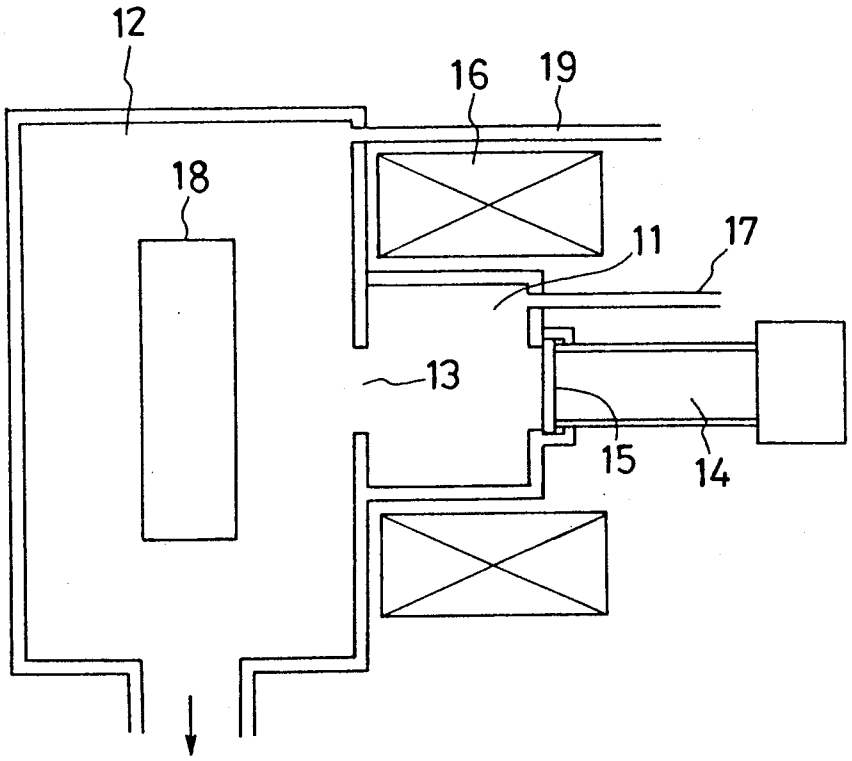
FIG. 3 is a schematic diagram of a deposition apparatus according to ECR process.

FIG. 3 shows a schematic diagram of a deposition apparatus according to ECR process. The deposition apparatus comprises a plasma formation chamber 11 and a deposition chamber 12 wherein film-deposition is made. The plasma formation chamber 11 and the deposition chamber 12 are evacuated by a turbo-molecular pump and a rotary oil pump (each not shown).

The plasma formation chamber 11 constructs a cavity resonator, to which microwave power with a frequency of 2.45 GHz is introduced through a rectangular waveguide 14 and a microwave introducing window 15 made of quartz glass. $H_2$, $N_2$ and an inert gas such as He, Ar or the like are introduced into the plasma formation chamber 11 through a gas tube 17. A magnetic coil 16 is provided around the plasma formation chamber 11 to form a magnetic field satisfying ECR conditions in a proper region inside the plasma formation chamber 11 and form divergent magnetic field by which excited plasma is extracted into the deposition chamber 12 through a plasma extraction window 13. A conductive substrate 18 for a photosensitive member which is to be situated in the deposition chamber 12 is made of a conductive material, for example, Al and in a cylindrical shape in this example. The cylindrical substrate 18 is supported rotatably by a supporting means (not shown) to uniformly deposit a film on its surface. The deposition chamber 12 is provided with a gas inlet tube 19 for introducing a source gas such as $SiH_4$ or the like.

The deposition process is conducted in the following manner. The plasma formation chamber 11 and the deposition chamber 12 are first evacuated, then $H_2$, $N_2$ and an inert gas such as He, Ar or the like are introduced into the plasma formation chamber 11 and a source gas into the deposition chamber 12. Specific examples of the source gases include silicon compounds having either hydrogen or halogen or both of them such as $SiH_4$, $Si_2H_6$, $SiF_4$, $SiCl_4$, $SiH_2Cl_2$ and the like. In this instance, gas pressure is set at about $10^{-3}$ to $10^{-4}$ Torr. Then, a current is supplied to the magnetic coil 16 to form a magnetic field, and microwave power is introduced into the plasma formation chamber 11 to form plasma. Excited plasma is introduced into the deposition chamber 12 through the plasma extraction window 13 to deposit a film on the substrate 18. The substrate 18 is rotated during deposition thereby enabling a uniform film-formation. Uniformity of deposition may be improved by changing the shape of the plasma extraction window 13 and a distance between the plasma extraction window 13 and the substrate 18.

Next, the properties of a-Si layer actually fabricated by the depositing apparatus mentioned above will be referred to.

Fabricated first was an a-Si film containing hydrogen under the following conditions:

| | |
|---|---|
| Microwave power: | 2.5 kW (EH mode) |
| Source gas: | 120 sccm ($SiH_4$) |
| Gas pressure: | 2.7 to 5.0 × $10^{-3}$ Torr |
| Substrate temperature: | without heating |

FIG. 1 shows a relationship between the hydrogen content in the a-Si film and the photoconductivity ($\eta\mu\tau$) and dark conductivity.

As shown in FIG. 1, the a-Si film fabricated according to ECR process exhibits a lower dark conductivity than those provided by the conventional process. In detail, the dark conductivity shown by the conventional a-Si film when not doped with impurity is $10^{-9}$ to $10^{-10}$ S/cm and that shown by the ECR a-Si film of the present invention is $10^{-11}$ to $10^{-12}$ S/cm. Also, when the hydrogen content is set to be 40 at. % or more, the ECR a-Si film exhibits a best photoconductivity $10^{-7}$ to $10^{-6}$cm$^2$/V which is the same as the conventional a-Si film with the hydrogen content of 10 to 30 at. %. The a-Si film having the favorable properties above is not able to be prepared by the conventional deposition methods and is sufficiently usable as a photoconductive layer of a photosensitive member for electrophotography of negative charge type, providing a good contrast in image on the basis of the large difference between the dark conductivity and photoconductivity.

When the hydrogen content in the a-Si layer is over 60 at. %, hydrogen may exists therein in $SiH_2$ polymer configuration, causing the photoconductivity to be lowered. Hence, it is preferable that the hydrogen content be set to 40 to 60 at. %. The favorable dark conductivity and photoconductivity were observed when the a-Si film contains halogen as well as or in place of hydrogen.

Figure 2:
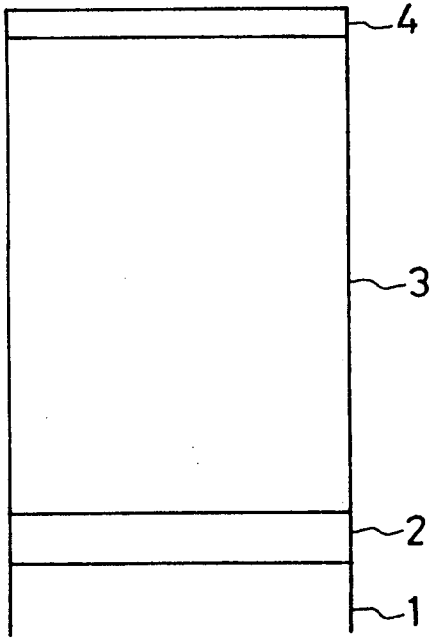
FIG. 2 is a cross sectional view showing a structure of the photosensitive member of the present invention.

FIG. 2 shows a structure of an photosensitive member for electrophotography which we practically prepared. The photosensitive member has an intermediate layer 2 (4 μm thick), a photoconductive layer 3 (35 μm) and a surface protecting layer 4 (0.5 μm) each deposited on a conductive substrate 1 made of aluminium and the like. The intermediate layer 2, photoconductive layer 3 and surface protecting layer 4 are formed with the depositing apparatus as aforesaid. The following table shows the deposition conditions for each layer.

| | Power of microwave (kW) | Flow rate (SCCM) | Gas pressure (Torr) |
|---|---|---|---|
| Intermediate Layer | 2.5 | $SiH_4$:120<br>$PH_3$*:12<br>NO:12 | 2.7 × $10^{-3}$ |
| Photoconductive Layer | 2.5 | $SiH_4$:120 | 2.7 × $10^{-3}$ |
| Surface Protecting Layer | 1.8 | $SiH_4$:10<br>$CH_4$:18 | 8.0 × $10^{-4}$ |

(*diluted by $H_2$ to 2000 ppm)

In preparation of a photosensitive member under the conditions, a higher deposition rate of about 23 μm/hr was achieved in comparison with the conventional deposition process and there was no generation of $SiH_2$ polymer. The hydrogen content of a photoconductive layer of the photosensitive member obtained was about 47 at. %.

An electrophotographic property as a negative charge type photosensitive member was measured on the above member to obtain a result that the photosensitive member has a sufficient charge acceptance and dark decay characteristic and exhibits a favorable photosensitivity superior to the conventional member, with having a less residual potential. The photosensitive member was mounted in a commercially available duplicator for an estimation of image quality and could provide a favorable image without having fogging.

To contain a halogen in the photoconductive layer, $SiH_2Cl_2$, $SiCl_4$, $SiF_4$ and the like may be used as a source gas to provide a similar result with the above.

As described above, the present invention provides an advantage that the non-doped a-Si which is inherently superior in photoconductivity is made use of without deteriorating the photoconductivity due to the addition, for example, of boron or like. In other words, adjusting the hydrogen and/or halogen content in the a-Si to 40 at. % or more decreases the dark conductivity thereby providing a sufficient charge acceptance and dark decay characteristic for a photosensitive member. The photosensitive member of an a-Si layer having hydrogen and/or halogen content of 40 at. % or more with a favorable property cannot be obtained by the conventional PCVD or reactive sputtering process but is realized by ECR process. ECR process eliminates such problems in the conventional depositing processes of (1) a lower deposition rate, (2) a lower gas usage efficiency, and (3) production of polymeric powder of $(SiH_2)n$ forms defects in a deposited layer. Further, the high quality a-Si layer can be obtained without heating the substrate, and cost reduction and improvement of productivity can be facilitated.

What we claimed is:

1. A photosensitive member for electrophotography which comprises an intermediate layer, a photoconductive layer and a surface protecting layer each formed upwardly in this order on a conductive substrate, the photoconductive layer comprising a non-doped a -Si layer made of an amorphous silicon containing hydrogen and/or halogen of 40 at. % or more and in which the intermediate layer is made of an a-Si layer doped with a n-type impurity.

2. A photosensitive member for electrophotography which comprises an intermediate layer, a photoconductive layer and a surface protecting layer each formed upwardly in this order on a conductive substrate, the photoconductive layer comprising a non-doped a-Si layer made of an amorphous silicon containing hydrogen and/or halogen of 40 at. % or more and in which the surface protecting layer is made of an a-SiC, a-SiN or a -SiO.

3. A photosensitive member for electrophotography which comprises an intermediate layer, a photoconductive layer and a surface protecting layer each formed upwardly in this order on a conductive substrate, the photoconductive layer comprising a non-doped a-Si layer made of an amorphous silicon containing hydrogen and/or halogen of 40 at. % or more and which is used as a photosensitive member of negative charge type.

4. A photosensitive member for electrophotography which comprises an intermediate layer, a photoconductive layer and a surface protecting layer each formed upwardly in this order on a conductive substrate, the photoconductive layer comprising a non-doped a-Si layer made of an amorphous silicon containing hydrogen and/or halogen of 40 at. % or more and in which the photoconductive layer has a photoconductivity of $10^{-7}$ to $10^{-6}$ $cm^2/V$ with a dark conductivity of $10^{-11}$ to $10^{12}$ S/cm.

* * * * *